US011822294B2

(12) United States Patent
Di Domenico et al.

(10) Patent No.: US 11,822,294 B2
(45) Date of Patent: Nov. 21, 2023

(54) TIMEPIECE MOVEMENT COMPRISING A ROTATING ELEMENT PROVIDED WITH A MAGNETIZED STRUCTURE HAVING A PERIODIC CONFIGURATION

(71) Applicant: The Swatch Group Research and Development Ltd, Marin (CH)

(72) Inventors: Gianni Di Domenico, Neuchatel (CH); Marc Stranczl, Nyon (CH); Benoit Legeret, Ecublens (CH); Rene Piguet, Cheseaux-sur-Lausanne (CH)

(73) Assignee: The Swatch Group Research and Development Ltd, Marin (CH)

( * ) Notice: Subject to any disclaimer, the term of this patent is extended or adjusted under 35 U.S.C. 154(b) by 788 days.

(21) Appl. No.: 16/891,168

(22) Filed: Jun. 3, 2020

(65) Prior Publication Data

US 2021/0018876 A1 Jan. 21, 2021

(30) Foreign Application Priority Data

Jul. 19, 2019 (EP) ..... 19187333

(51) Int. Cl.
*G04C 5/00* (2006.01)
*G04B 15/14* (2006.01)

(52) U.S. Cl.
CPC ..... *G04C 5/005* (2013.01); *G04B 15/14* (2013.01)

(58) Field of Classification Search
CPC ..... G04C 5/005; G04C 3/105; G04C 11/081; G04B 15/14; G04B 15/00
See application file for complete search history.

(56) References Cited

U.S. PATENT DOCUMENTS

2016/0357155 A1* 12/2016 Di Domenico ..... G04B 17/04
2016/0370766 A1* 12/2016 Winkler ..... G04C 5/005
(Continued)

FOREIGN PATENT DOCUMENTS

CH 713 070 A2 4/2018
CN 103384856 A 11/2013
(Continued)

OTHER PUBLICATIONS

Combined Chinese Office Action and Search Report dated Jun. 16, 2021 in Chinese Patent Application No. 202010691556.5 (with English translation of Category of Cited Documents), 8 pages.
(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A timepiece movement includes a magnetic escapement formed of a magnetic escape wheel with an annular magnetized structure and a pallet fork whose shaft is formed by a ferromagnetic material. The pallet shaft exerts on the escape wheel a magnetic disturbance torque due to the fact that the annular magnetized structure exhibits an angular variation of at least one defining physical parameter thereof, such that the magnetic attraction varies as a function of the angular position of the escape wheel and has a tangential component. A magnetic compensation pin is incorporated in the timepiece movement, this magnetic compensation pin being arranged such that the second magnetic disturbance torque that it exerts on the escape wheel exhibits an angular phase shift relative to the first magnetic disturbance torque generated by the pallet shaft, so as to compensate largely for this first magnetic disturbance torque.

14 Claims, 7 Drawing Sheets

(56) References Cited

U.S. PATENT DOCUMENTS

| | | | | |
|---|---|---|---|---|
| 2017/0038737 | A1* | 2/2017 | Di Domenico | G04B 11/026 |
| 2017/0242403 | A1* | 8/2017 | Di Domenico | G04C 5/005 |
| 2018/0181073 | A1* | 6/2018 | Tombez | G04C 3/04 |

FOREIGN PATENT DOCUMENTS

| | | | |
|---|---|---|---|
| CN | 106030422 | A | 10/2016 |
| CN | 107092179 | A | 8/2017 |
| CN | 107976889 | A | 5/2018 |
| EP | 3 208 667 | A1 | 8/2017 |
| EP | 3 299 907 | A1 | 3/2018 |
| WO | WO 2015/096979 | A2 | 7/2015 |

OTHER PUBLICATIONS

European Search Report dated Jan. 27, 2020 in European Application 19187333.0 filed on Jul. 19, 2019 (with English Translation of Categories of Cited Documents), 4 pages.

* cited by examiner

TIMEPIECE MOVEMENT COMPRISING A ROTATING ELEMENT PROVIDED WITH A MAGNETIZED STRUCTURE HAVING A PERIODIC CONFIGURATION

CROSS-REFERENCE TO RELATED APPLICATION

This application claims priority to European Patent Application No. 19187333.0 filed on Jul. 19, 2019, the entire disclosure of which is hereby incorporated herein by reference.

FIELD OF THE INVENTION

The invention concerns timepiece movements provided with at least one rotating element participating in at least one magnetic system of the timepiece movement, this rotating element being provided with an annular magnetized structure exhibiting angular variation of at least one defining physical parameter thereof.

A 'rotating element' means an element arranged in the timepiece movement so that it can undergo a certain rotation, in a given direction or in both directions. Thus, this expression applies, for example, as much to an escape wheel as to a balance.

BACKGROUND OF THE INVENTION

Various timepiece movements comprising at least one magnetic system involved in the operation of the timepiece movement are known from the prior art. In particular, there are known timepiece movements equipped with a magnetic escapement formed by a magnetic system in which at least one magnet, carried by a pallet fork, and at least one pallet wheel participate. Such magnetic escapements are described in particular in Patent documents EP2887157, EP3128379, EP3128379, EP3208667, EP3217227 and CH712154. There are also known timepiece movements having a magnetic escapement without a stopping device wherein one part of the magnetic system is carried by the mechanical resonator of the timepiece movement and the other part is carried by an escape wheel. Such timepiece movements are described in particular in Patent documents CH709031 and CH713070.

SUMMARY OF THE INVENTION

When a rotating element carries an annular magnetized structure and the latter exhibits an angular variation of at least one defining physical parameter thereof, the inventors observed that, in the presence of at least one ferromagnetic part located, in particular, at the periphery of the rotating element, not only does this ferromagnetic part exert a radial attraction on the annular magnetized structure, such that a parasitic friction force is generated in the bearings of the shaft of the rotating element, but the rotating element is also subjected to a magnetic disturbance torque that varies as a function of the angular position of the rotating element. Such a magnetic disturbance torque disturbs the proper operation of the magnetic system in which the rotating element participates, in particular in the case of a magnetic escapement having an escape wheel of the aforementioned rotating element type.

Having highlighted this technical problem, the inventors sought a technical solution. The first thought that comes to mind is to remove the magnetic elements (magnets and elements made of ferromagnetic material) near the rotating element or to move them sufficiently far away from the latter to render their interaction with the annular magnetized structure negligible. However, it is often not easy to change the materials selected for the various elements and components of the timepiece movement. Thus, although there are known non-ferromagnetic materials for making the arbors/shafts of rotating elements, it is sometimes preferable for other technical reasons, or for questions of manufacturing costs, to retain steel, in particular, for such arbors/shafts. Then, it is often not possible to move the magnetic elements away from the environment of the rotating element in question without modifying the design of the timepiece movement. For example, a magnetic pallet fork having a steel shaft must remain at the periphery of the magnetic escape wheel with which the magnetic pallet fork is associated. Thus, the inventors decided to seek a technical solution to overcome the specific technical problem, namely the manifestation of a magnetic disturbance torque, which requires neither having to change the nature of the magnetic elements in the environment of a rotating element provided with a magnetized structure exhibiting an angular variation of at least one physical parameter, nor having to modify the design of the timepiece movement, i.e. its various functional parts and the interactions therebetween.

To this end, the present invention concerns a timepiece movement comprising a mechanism formed by a rotating element, provided with an annular magnetized structure exhibiting angular variation of at least one defining physical parameter thereof, and by a first set of magnetic elements which consists of one functional magnetic element or of a plurality of functional magnetic elements, this first set of magnetic elements not being integral in rotation with the rotating element and having overall with the annular magnetized structure a first magnetic interaction which generates a first magnetic disturbance torque on the rotating element. The timepiece movement further comprises a second set of magnetic elements which consists of a magnetic compensation element or of a plurality of magnetic compensation elements not forming part of any timepiece movement mechanism, this second set of magnetic elements not being integral in rotation with the rotating element and having overall with the annular magnetized structure a second magnetic interaction which generates a second magnetic disturbance torque on the rotating element. The second set of magnetic elements is arranged relative to the first set of magnetic elements such that the maximum absolute torque value resulting from the addition of the first magnetic disturbance torque to the second magnetic disturbance torque is lower than the maximum absolute value of the first magnetic disturbance torque.

According to a main embodiment, the first magnetic disturbance torque as a function of the angular position of the rotating element defines a first sinusoidal type curve exhibiting an angular period equal to 350°/N with N being an integer number greater than one (N>1). Further, the second set of magnetic elements is arranged relative to the first set of magnetic elements such that the second magnetic disturbance torque as a function of the angular position of the rotating element defines a second sinusoidal type curve also exhibiting said angular period, and such that the first and second magnetic disturbance torques exhibit therebetween an angular phase shift substantially equal to 180°.

According to an improved embodiment, the second set of magnetic elements consists of K magnetic compensation elements or K groups of magnetic compensation elements substantially exhibiting the same configuration, K being an integer number greater than one (K>1). The K magnetic compensation elements or groups of magnetic compensation elements are arranged such that K magnetic disturbance torques, respectively generated on the rotating element by these K magnetic compensation elements or groups of magnetic compensation elements, exhibit relative to the first magnetic disturbance torque respectively K angular phase shifts which are respectively equal to substantially J·360°/(K+1) with J being an integer number ranging from one to K, i.e. J=1, . . . , K.

Owing to the characteristics of the subject of the invention, the overall magnetic disturbance torque, which is exerted by at least one functional magnetic element on the rotating element provided with an annular magnetized structure, is therefore reduced, by adding at least one magnetic compensation element in the space surrounding this rotating element.

In an advantageous embodiment wherein the integer number K is equal to two (K=2), the annular magnetized structure is configured and the magnetic compensation element is arranged such that the maximum absolute value of said resulting torque is less than 15% of the maximum value of the first magnetic disturbance torque.

BRIEF DESCRIPTION OF THE DRAWINGS

The invention will be described in more detail below with reference to the annexed drawings, given by way of non-limiting example, in which.

DETAILED DESCRIPTION OF THE INVENTION

Figure 1:
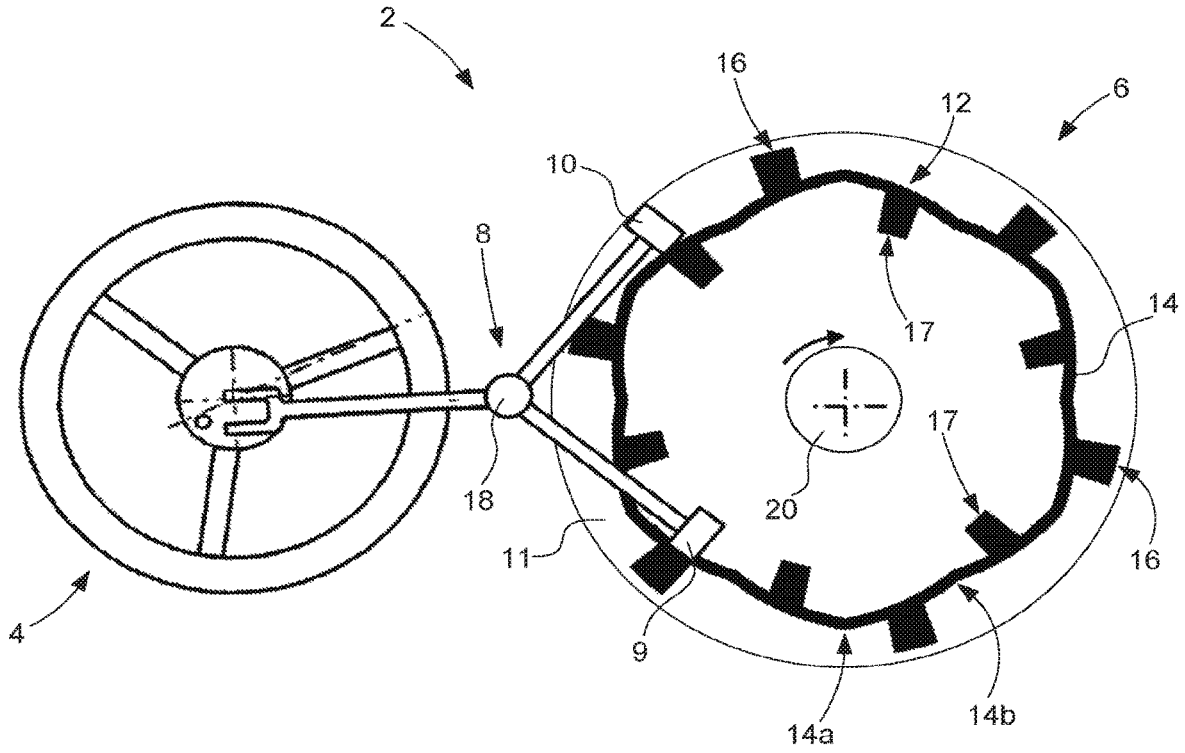
FIG. 1 is a partial, simplified view of a mechanical timepiece movement provided with a magnetic escapement disclosed in Patent document EP3208667.
Figure 2:
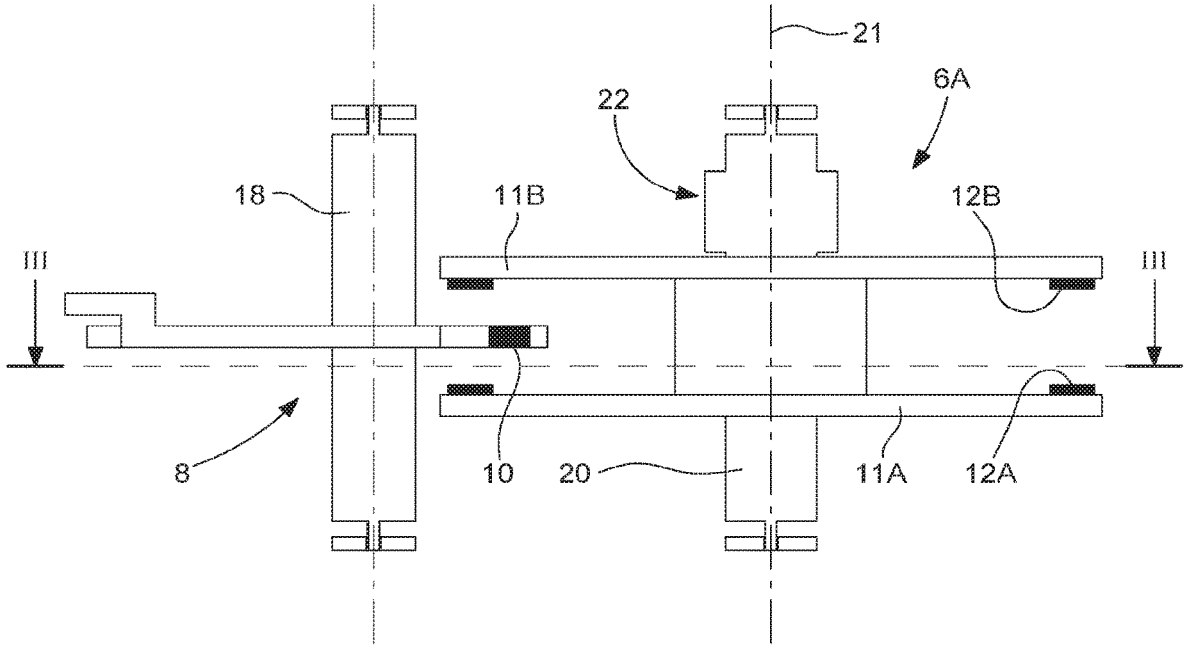
FIG. 2 is a cross-section of a magnetic escapement of the type disclosed in Patent document EP3208667.
Figure 3:
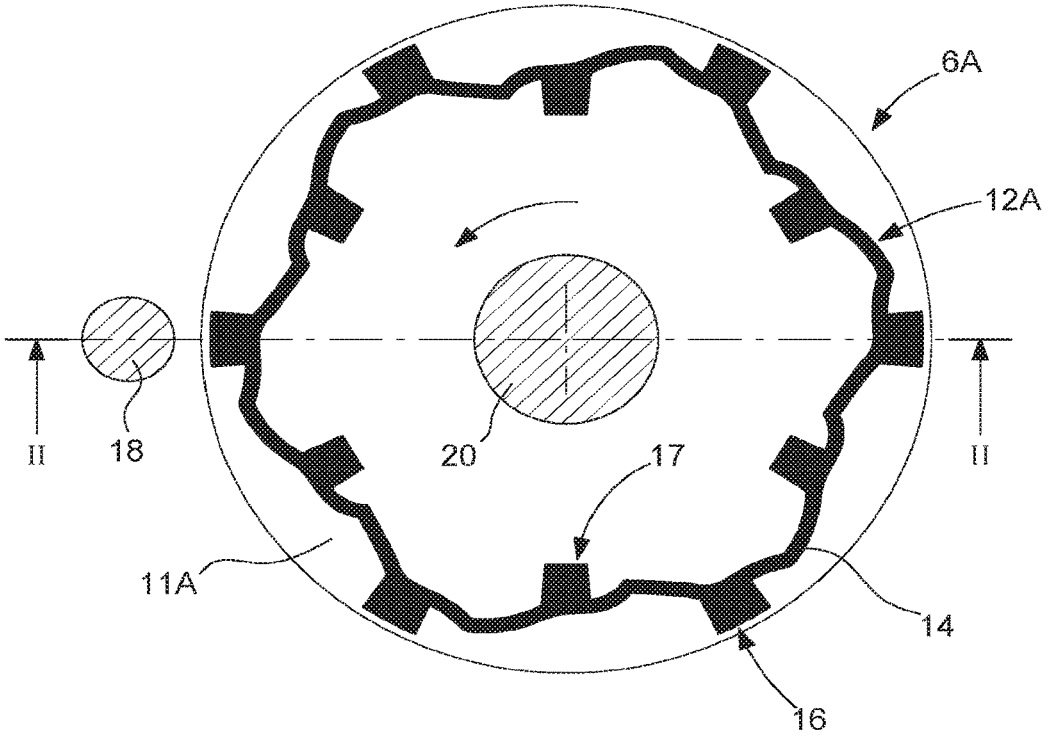
FIG. 3 is a partial, horizontal sectional view of the magnetic escapement of FIG. 2.

Referring to FIGS. 1 to 4, there will be described hereinafter a prior art mechanical timepiece movement 2 to better highlight the technical problem posed by such a timepiece movement, which is provided with a balance 4 and a magnetic escapement formed by a magnetic pallet fork 8 and an escape wheel referenced 6 in the variant of FIG. 1, respectively 6A in the variant of FIGS. 2 and 3. The magnetic pallet fork is provided with two magnetic pallet stones 9, 10 arranged at the free ends of two arms.

In the variant of FIG. 1, escape wheel 6 comprises a non-magnetic support 11 on which is arranged a structured magnetized layer 12 which alone forms an annular magnetized structure of the escape wheel. This structured magnetized layer has a magnetized track 14 which surrounds arbor 20 of the escape wheel along a generally circular line but with convex, i.e. outward portions 14*a* and concave, i.e. inward portions 14*b*. Further, the structured magnetized layer 12 has outer magnetized areas 16 and inner magnetized areas 17 which are respectively located on both sides of magnetized track 14 and which define magnetic barriers for the magnetic pallet stones of pallet fork 8. The operation of such a magnetic escapement is described in the documents cited above in the background of the invention, such that reference can be made to these documents for comprehension thereof.

In the variant of FIGS. 2 and 3, escape wheel 6A comprises two structured magnetized layers 12A and 12B which are each identical to layer 12 of FIG. 1 and which are arranged axially facing each other with areas 16 and 17 of layer 12A superposed on the corresponding areas of layer 12B. The two layers 12A and 12B are arranged on two respective supports 11A and 11B, made of non-magnetic material, which are fixedly mounted on arbor 20, which includes a drive pinion 22 of escape wheel 6A. The two structured magnetized layers are located on the side of an intermediate space defined by the two supports 11A, 11B and which is penetrated by the two respective ends of the two arms of pallet fork 8, so as to allow a magnetic interaction between the magnetic pallet stones of the pallet fork and the two layers 12A and 12B. The two structured magnetized layers 12A, 12B together form an annular magnetized structure of magnetic escape wheel 6A. The two layers 12A, 12B each have a constant thickness, such that the annular magnetized structure also has a constant axial thickness.

As indicated in the summary of the invention, for various reasons, pallet shaft 18 is made here of ferromagnetic material. Generally, in the context of the invention, a timepiece movement is considered which comprises a mechanism formed by a rotating element, provided with an annular magnetized structure exhibiting an angular variation of at least one physical parameter defining this annular magnetized structure, and by a first set of magnetic elements which consists of at least one functional magnetic element, this first set of magnetic elements not being integral in rotation with the rotating element and having overall a first magnetic interaction with the annular magnetized structure. In the examples considered in the detailed description of the invention, the rotating element is a magnetic escape wheel. However, the rotating element can be another component, in particular a balance. Then, in the examples considered, the first set of magnetic elements consists of at least one arbor made of ferromagnetic material, in particular the pallet shaft associated with the escape wheel and/or the arbor of an intermediate wheel set located in proximity to this wheel and forming a train which transmits the torque from a barrel to the escape wheel. It will be understood that the invention is not limited simply to arbors made of ferromagnetic materials, but applies to any other magnetic element able to be arranged at the immediate periphery of the rotating element in question, in particular of a magnetic escape wheel, and to exhibit a significant magnetic interaction with its annular magnetized structure. A 'magnetic element' means a magnet, a ferromagnetic element or a combination of the two.

It will be noted that, in the variant considered in FIGS. 2 and 3, essentially two physical parameters of the annular magnetized structure exhibit an angular variation, namely the radial width of each structured magnetized layer 12A, 12B and the mean distance of each structured magnetized layer to the axis of rotation 21 of escape wheel 6A. The angular variations in the radial width and in the mean distance to the axis of rotation of the two layers 12A, 12B, and thus of the annular magnetized structure, are periodic, such that the annular magnetized structure has an angular period equal to 360°/N with N being an integer number greater than one (N>1). In particular, in the variant considered, the annular magnetized structure has an angular period PA equal to 360°/N with N=6, namely an angular period of 60° or $\pi/3$ [rad].

Ferromagnetic shaft 18 forms a body of revolution such that the volume of magnetic material that it defines remains invariant regardless of the angular position of pallet fork 8. Thus, because wheel 6A comprises a periodic annular magnetized structure, the first magnetic interaction between magnetic shaft 18 and annular magnetized structure 12A-12B of wheel 6A generates on said wheel a first magnetic disturbance torque which substantially depends only on the angular position of wheel 6A and which periodically varies as a function of the angular position of wheel 6A having, in the variant considered, the same angular period PA, here 60° or $\pi/3$ [rad], as the annular magnetized structure 12A-12B. A portion of the first magnetic disturbance torque curve 30 is shown in FIG. 4.

Curve 30, although not exactly defining a function $F(\theta)=A\cdot\sin\theta$, is of the sinusoidal type. A 'sinusoidal type curve', means an alternately positive and negative curve, with positive extreme values which are close, normally identical, but may differ slightly, and negative extreme values which are close, normally identical but may differ slightly. Further, the positive extreme values and the negative values are, in absolute values, close to each other, preferably almost identical but they may differ to some extent, for example from 10% to 20%. A periodic character can be identified in such a curve where the period is the angular distance between two positive extreme values or, in an equivalent manner, two negative extreme values. Finally, the two half-periods forming the period of such a curve can have different values, as is the case of curve 30 in FIG. 4, although it is advantageous for the two half-periods to have substantially the same value.

Figure 4:
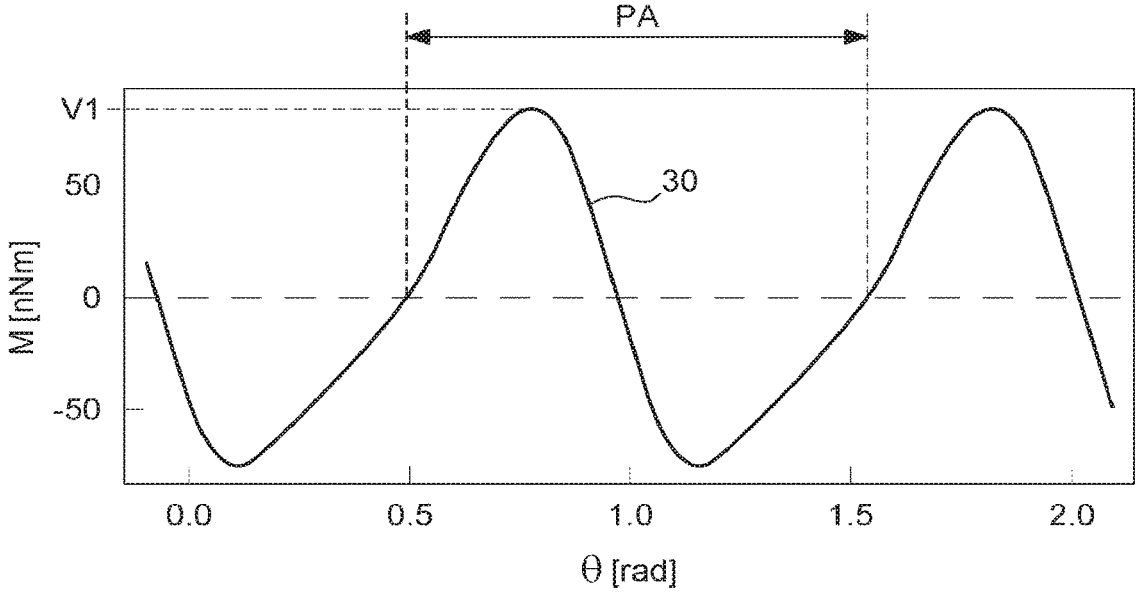
FIG. 4 shows the curve of a disturbance torque generated by the magnetic pallet shaft on the escape wheel as a function of the angular position of said wheel with the magnetic escapement of FIGS. 2 and 3.
Figure 5:
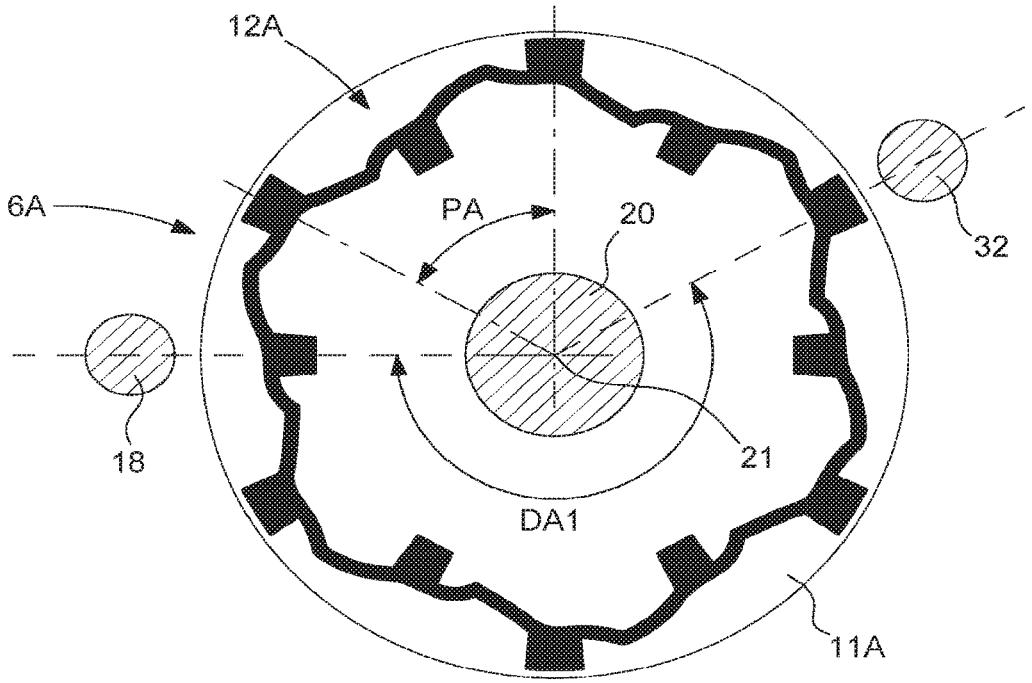
FIG. 5 partially shows a first embodiment of a mechanical movement according to the invention.

In a first embodiment of the invention represented in FIG. 5, the timepiece movement is similar to that of the prior art described above with regard to the mechanism(s) of which it is composed and it further comprises a magnetic compensation element 32 which is similar in shape to magnetic shaft 18, or more generally, configured to generate on the annular magnetized structure, in particular on structured magnetized layer 12A of which it is formed, a torque having substantially the same intensity as that of the torque produced by shaft 18 (FIG. 4). This magnetic compensation element 32 consists here of a magnetic pin, arranged at the periphery of the magnetic escape wheel and formed by a ferromagnetic material, and it is arranged to exhibit an angular offset relative to the magnetic shaft, added to an angular period of periodic structured magnetized layer 12A and thus to the angular period of the periodic annular magnetized structure. A second magnetic disturbance torque generated by magnetic pin 32 defines a similar curve to curve 30 of FIG. 4, but the first and second magnetic disturbance torques exhibit therebetween a phase shift of around 180°, preferably of 180°. This 180° phase shift corresponds to an angular phase shift between magnetic shaft 18 and magnetic pin 32 which is equal to $[(2M-1)/N]\cdot 180°$, with N being the number of angular periods of the annular magnetized structure, namely N=6 in the example represented, and M being a positive integer number which is less than or equal to N.

Figure 6:
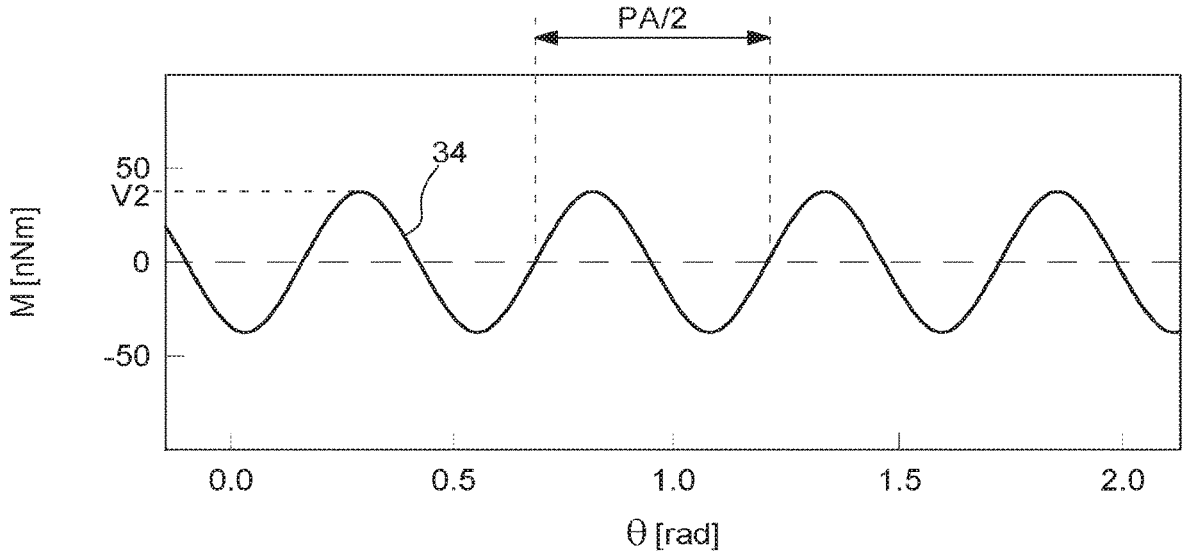
FIG. 6 shows a curve of a remaining disturbance torque which is exerted on the escape wheel as a function of its angular position in the first embodiment.
Figure 7:
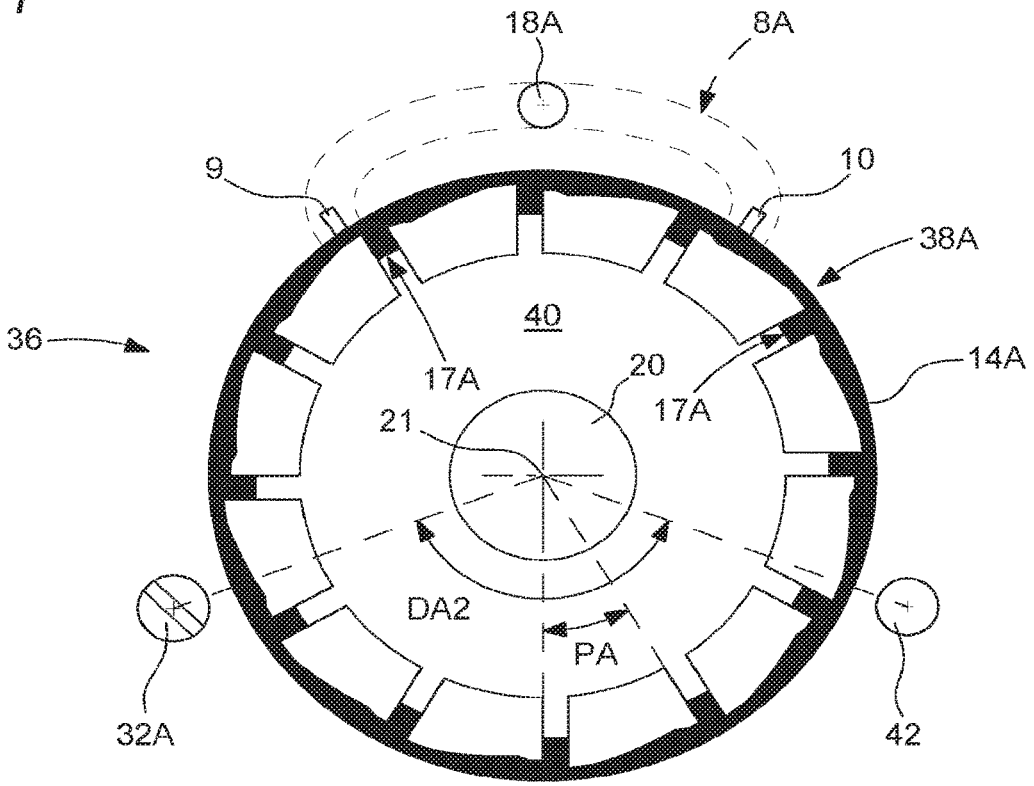
FIG. 7 partially shows a second embodiment of a mechanical movement according to the invention.

Preferably, magnetic pin 32 is arranged on the diametrically opposite side to functional magnetic shaft 18 in order also to compensate largely for the magnetic force of attraction exerted by this shaft 18 on escape wheel 6A. The torque resulting from the addition of the first and second magnetic disturbance torques is represented in FIG. 6. Firstly, it is observed that the maximum absolute value V2 of this resultant torque is less than the maximum absolute value V1 of the first magnetic disturbance torque represented in FIG. 4. In the example discussed here, the maximum absolute value V2 of the resultant torque is slightly less than half the maximum absolute value V1 of the first magnetic disturbance torque. Next, it is also observed that the resultant torque curve 34 has a period equal to half the angular period PA of structured magnetized layer 12A and thus of the annular magnetized structure. This is easily explained by the fact that the arrangement of a 180° phase-shifted compensation shaft generates magnetic configurations which are identical for one half-period PA/2 rotation of escape wheel 6A. If curve 30 is decomposed into Fourier series, the addition of two such 180° phase-shifted curves cancels the harmonic of rank n=1 (also called the fundamental frequency), but doubles the harmonic of rank n=2, which has a period equal to half the fundamental frequency period, this latter period being equal to period PA of curve 30 of the first magnetic disturbance torque.

Generally, the timepiece movement further comprises a second set of magnetic elements which consists of a magnetic compensation element or of a plurality of magnetic compensation elements not forming part of any timepiece movement mechanism, this second set of magnetic elements not being integral in rotation with the rotating element and having overall with the annular magnetized structure a second magnetic interaction which generates a second magnetic disturbance torque on the rotating element. According to the invention, the second set of magnetic elements is arranged relative to the first set of magnetic elements such that the maximum absolute torque value resulting from the addition of the first and second magnetic disturbance torques is lower than the maximum absolute value of the first magnetic disturbance torque.

In a main embodiment, to which the first embodiment described above corresponds, the first magnetic disturbance torque as a function of the angular position of the rotating element defines a first sinusoidal type curve exhibiting an angular period equal to 350°/N with N being an integer number greater than one (N>1). Further, the second set of magnetic elements is arranged relative to the first set of magnetic elements such that the second magnetic disturbance torque as a function of the angular position of said rotating element defines a second sinusoidal type curve also exhibiting said angular period, and such that the first and second magnetic disturbance torques exhibit therebetween an angular phase shift substantially equal to 180°.

Referring to FIGS. 7 and 8A to 8D, a second embodiment will be described which also corresponds to the aforementioned main embodiment. The timepiece movement, partially represented in FIG. 7, comprises a magnetic escape wheel 36 provided with an annular magnetized structure formed, as in FIG. 2, of two structured magnetized layers of which only the lower layer 38A appears in FIG. 7. The escape wheel comprises an arbor 20 and a non-magnetic support 40 carrying lower magnetized layer 38A. This escape wheel is arranged to rotate around an axis of rotation 21. It is associated with a magnetic pallet fork 8A, which consists of a magnetic shaft 18A and two non-magnetic arms, represented in dotted lines, which respectively carry at their free ends two magnetized pallet stones 9, 10. The structured magnetized layer 38A and the annular magnetized structure formed by this structured magnetized layer differ from layer 12A and from the annular magnetized structure of FIG. 5 by a new configuration.

The annular magnetized structure formed of structured magnetized layer 38A or of two such superposed layers, as represented in FIG. 2, defines magnetic barriers 17A for the magnetic pallet fork which are angularly shifted by angular period PA. It will be noted that only inner magnetized areas 17A have been provided in the advantageous variant considered. Layer 38A has a constant thickness and defines a magnetized track 14A having a variable radial width. Preferably, the annular magnetized structure is configured such that its external profile is substantially circular and continuous, as in the case of the advantageous variant of FIG. 7. A 'circular external profile', in the case of a structure having two structured magnetized layers, means that each layer has an external profile which is substantially circular. In such case, preferably, the diameters of the two structured magnetized layers are equal, such that the external profiles of these two layers define a cylindrical geometric surface. Such an arrangement of the annular magnetized structure makes it possible, on the one hand, to reduce the first magnetic disturbance torque generated by the functional magnetic element or elements at the periphery of escape wheel 36, and on the other hand, to decrease the ratio between the maximum absolute value of the resultant torque (from the addition of the first magnetic disturbance torque and the magnetic disturbance torque generated by the compensation pin) and that of the first magnetic disturbance torque.

Figure 8D:
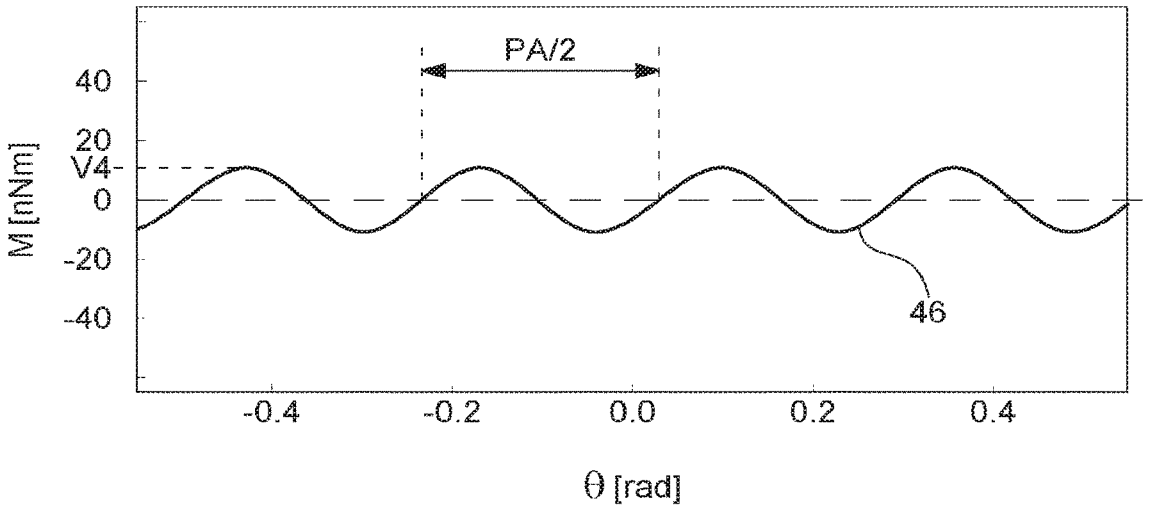
FIG. 8D shows the remaining disturbance torque which is exerted on the escape wheel as a function of its angular position in the second embodiment.
Figure 8A:
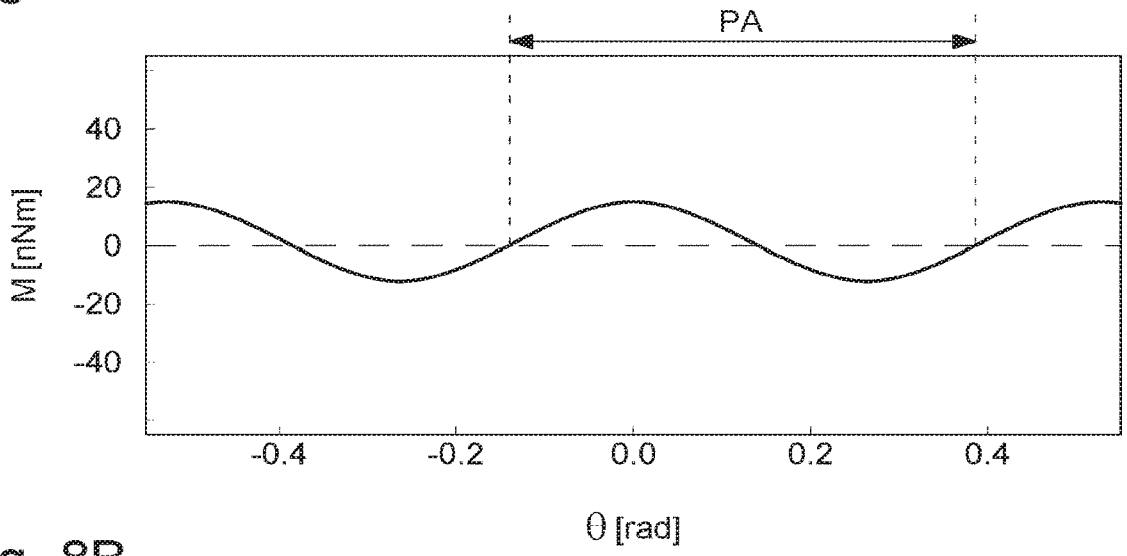
FIGS. 8A and 8B respectively show the two curves of disturbance torques generated on the escape wheel as a function of the angular position of the escape wheel, individually by the pallet shaft and the arbor of an intermediate wheel set, in the second embodiment.
Figure 8B:
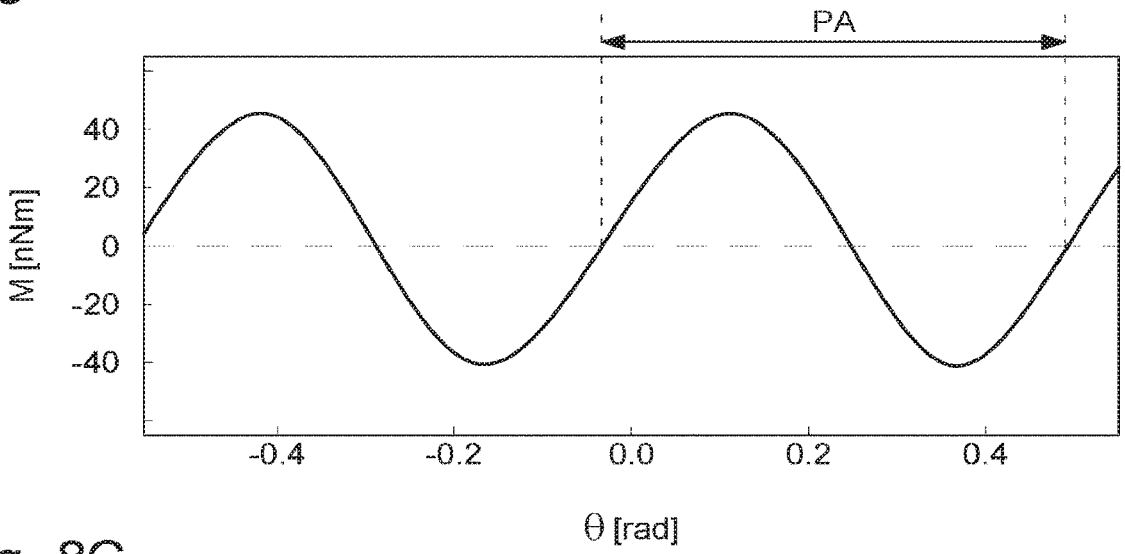
Figure 8C:
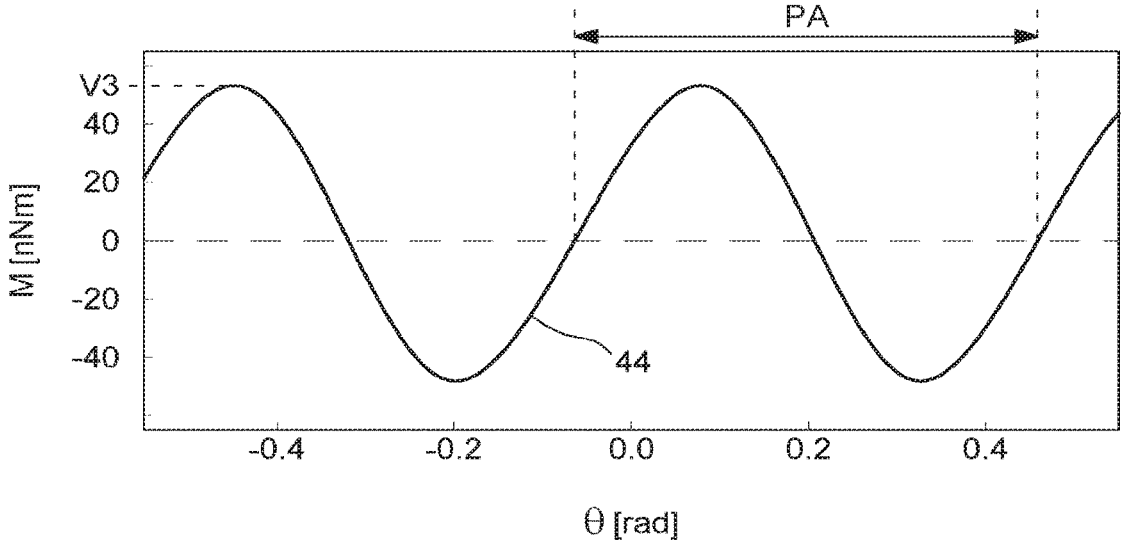
FIG. 8C shows a disturbance torque exerted overall on the escape wheel by the functional magnetic elements, which are the pallet shaft and the arbor of the intermediate wheel set, in the second embodiment.

The second embodiment further differs from the first in that there are two magnetic functional elements at the immediate periphery of the escape wheel here, namely magnetic shaft 18A of pallet fork 8A and magnetic arbor 42 of an intermediate wheel set forming a train between the escape wheel and a barrel of the timepiece movement and meshing with the escape wheel pinion. FIGS. 8A and 8B represent the individual magnetic torques which are respectively generated by the two magnetic arbors 18A and 42 (at least partially made of ferromagnetic material). FIG. 8C represents curve 44 of the first magnetic disturbance torque generated overall by the functional magnetic elements, other than the magnetic pallet stones of the pallet fork, which are located in proximity to the annular magnetized structure of escape wheel 36. It is observed that the individual magnetic torques have periodic curves with the angular period PA of the annular magnetized structure, this angular period PA being equal to 30°, namely 360°/N with N=12 corresponding to the number of angular periods of the annular magnetized structure of FIG. 7. Next, it is observed that the individual magnetic torque generated by arbor 42 is dominant. Finally, given that there is a relatively small angular offset between the two arbors 18A and 42 with respect to the angular period PA of structured magnetized layer 38A, the first magnetic disturbance torque (FIG. 8C) has a curve 44 close to that of FIG. 8B, also with a period PA, these two curves having a certain phase shift between them.

Preferably, magnetic compensation pin 32A is arranged such that the individual magnetic torque, forming the second magnetic disturbance torque, that it exerts on the escape wheel has an angular phase shift of 180° with the first magnetic disturbance torque, and not with the individual magnetic torque of ferromagnetic arbor 42 (FIG. 8B), although the latter is largely dominant. Next, given that the first set of magnetic elements, which consists of functional magnetic elements, has two functional magnetic elements, pin 32A is designed to optimise the compensation that it generates, particularly its diameter and/or its distance to axis of rotation 21 is/are adjusted so that the maximum absolute value of the second magnetic disturbance torque, generated by compensation pin 32A, provides the best compensation for the first magnetic disturbance torque and so that the resultant torque, whose curve 46 is given in FIG. 8D, from the addition of the first and second magnetic disturbance torques therefore has the smallest possible amplitude, i.e. the smallest possible maximum absolute value.

Owing to the configuration of structured magnetized layer 38A, and thus to the annular magnetized structure that it forms, and to the arrangement of magnetic compensation pin 32A, the maximum absolute value V4 of the torque resulting from the addition of the aforementioned first and second magnetic disturbance torques is less than 30% of the maximum absolute value V3 of the first magnetic disturbance torque. Indeed, in the example described, it is observed that the ratio between the maximum absolute value V4 of curve 46 and maximum absolute value V3 of curve 44 is around ⅕.

An improvement is proposed in the described variant of the second embodiment in that compensation pin 32A is arranged such that its position relative to axis of rotation 21 can be adjusted in order to regulate the angular phase shift and/or the maximum absolute value of the second magnetic disturbance torque (curve 44) and thus to optimise the resultant torque curve (curve 46), in particular the maximum absolute value V4 of the resultant torque, i.e. to reduce the maximum absolute value to the smallest possible value. More specifically, pin 32A forms an eccentric that the watchmaker can rotate using a tool to adjust its distance to the axis of rotation and therefore to the annular magnetized structure. If one does not wish to vary the angular position of the compensation pin, in a variant it is possible to arrange the compensation pin in a sort of radial slide-bar. Those skilled in the art will know how to provide the means necessary to adjust the radial and/or angular position of this compensation pin.

Figure 9:
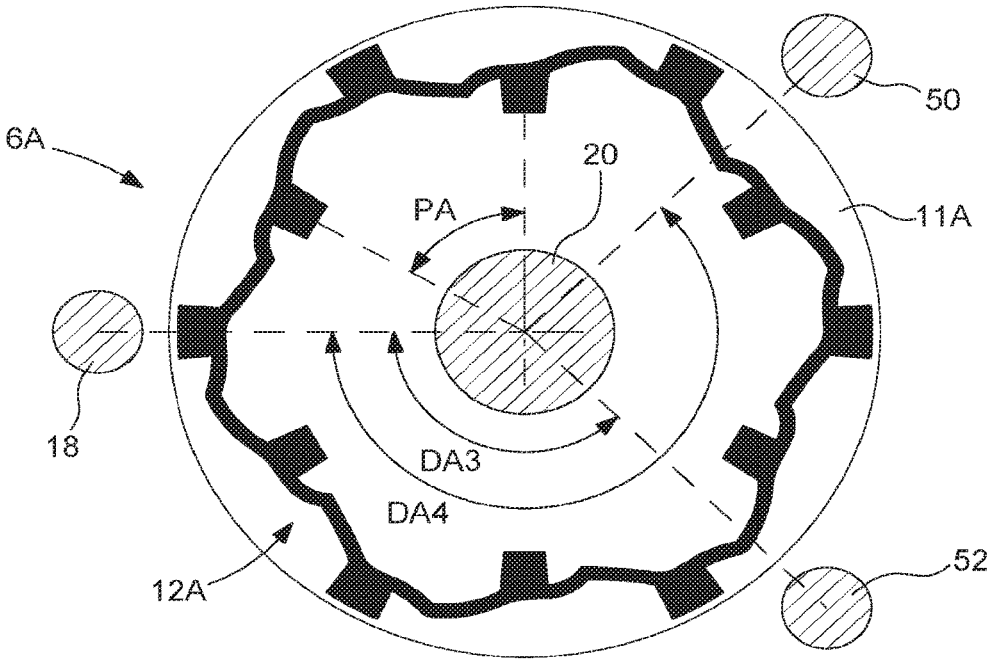
FIG. 9 partially shows a third embodiment of a mechanical movement according to the invention.
Figure 10:
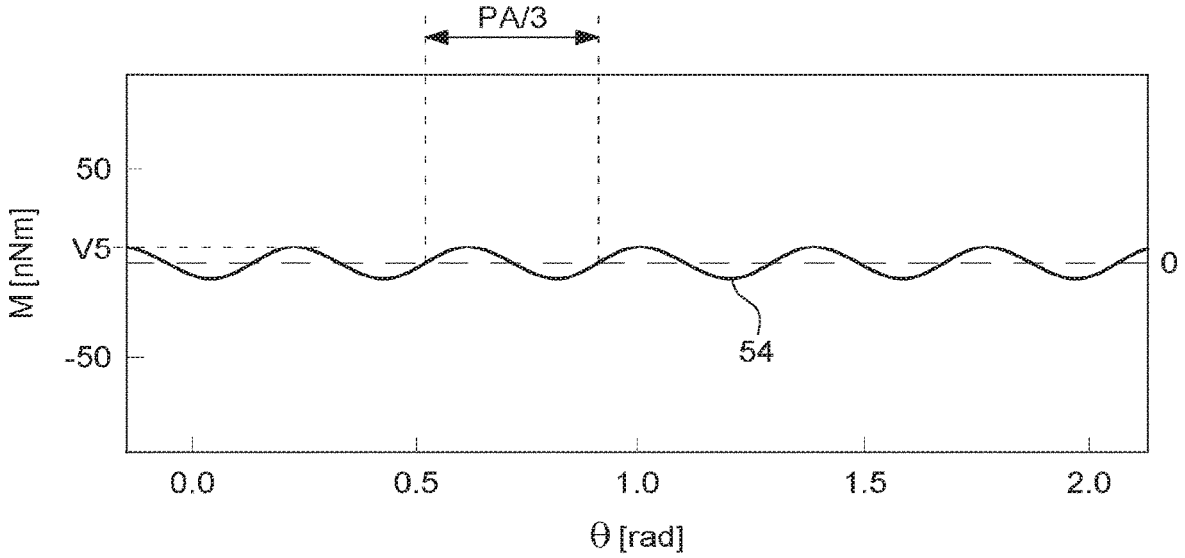
FIG. 10 shows the remaining disturbance torque which is exerted on the escape wheel as a function of its angular position in the third embodiment.

Referring to FIGS. 9 to 10, a third embodiment of the invention will be described below. This third embodiment differs from the first embodiment only in that the single compensation pin of the second embodiment is replaced with two compensation pins 50, 52 similar to magnetic shaft 18 which here constitutes the set of functional magnetic elements concerned (the magnetic arbor concerned can be either the pallet shaft, or the arbor of an intermediate wheel set meshing with escape wheel 6A). The two compensation pins are arranged such that the two individual magnetic torques that they respectively exert on the escape wheel are phase-shifted respectively by 120° and 240° (equivalent to −120°) relative to the first magnetic disturbance torque generated by magnetic shaft 18. In other words, in the present case, the two magnetic compensation elements 50, 52 have an angular offset relative to each other whereby the remainder of the integer division by angular period PA is equal to 360°/(3·N) where N is the number of angular periods of the annular magnetized structure, i.e. N=6 in the example considered. Next, since only one functional magnetic element 18 is considered here, the two magnetic compensation elements are arranged to have two angular offsets relative to the functional magnetic element whereby the two remainders of the integer division of each by angular period PA are respectively equal to 360°/3·N and 720°/3·N, i.e. 20° and 40° (note that PA=60°). Further, the two magnetic compensation pins 50 and 52 are arranged to distribute as evenly as possible these two magnetic compensation pins and the magnetic shaft 18 around the axis of rotation to minimise friction in the escape wheel bearings due to the magnetic attraction exerted by each of them on the annular magnetized structure of this wheel.

FIG. 10 shows the curve 54 of the resultant torque exerted overall by the two compensation pins and the functional magnetic element of FIG. 9. Firstly, it is observed that the maximum absolute value V5 of curve 54 is relatively low. It is less than 20% of the maximum absolute value V1 of the first magnetic disturbance torque (see FIG. 4). Next, curve 54 is periodic and has an angular period equal to one third of angular period PA of the annular magnetized structure, i.e. an angular period equal to PA/3. It is thus clear that the arrangement of two compensation pins, with the aforementioned angular offsets relative to magnetic shaft 18, generates a second magnetic disturbance torque which compensates for the first two harmonics (n=1, 2) of the Fourier series decomposition of the first magnetic disturbance torque generated by the functional magnetic arbor. However, the third harmonic is strengthened, which is why a periodic curve 54 is obtained with a period equal to PA/3. Since the third harmonic (n=3) has a relatively low amplitude, the resultant torque curve has a maximum absolute value V5 which is much lower than the corresponding values V2 and V4 of the two preceding embodiments. Taking escape wheel 36 of the second embodiment, this maximum absolute value can be further reduced, as appears in FIG. 12.

Figure 11:
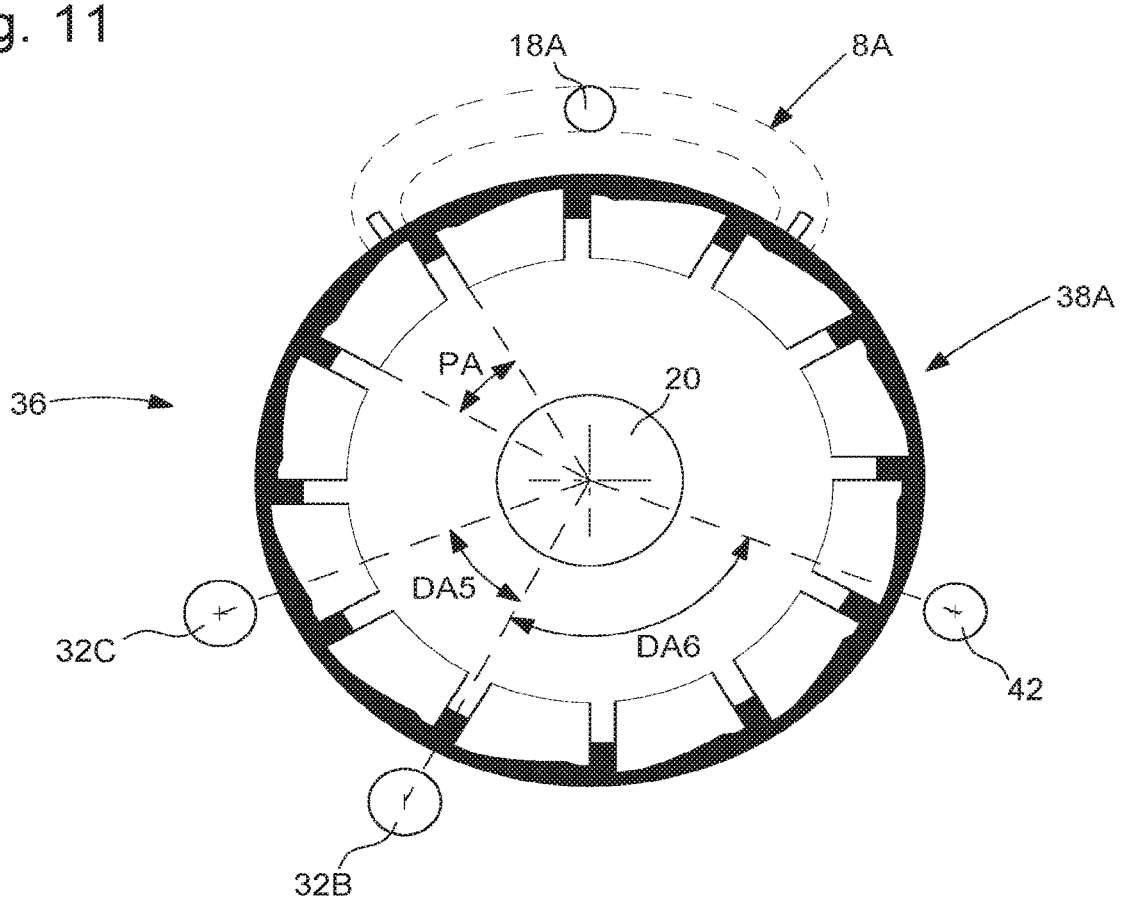
FIG. 11 partially shows a fourth embodiment of a mechanical movement according to the invention.
Figure 12:
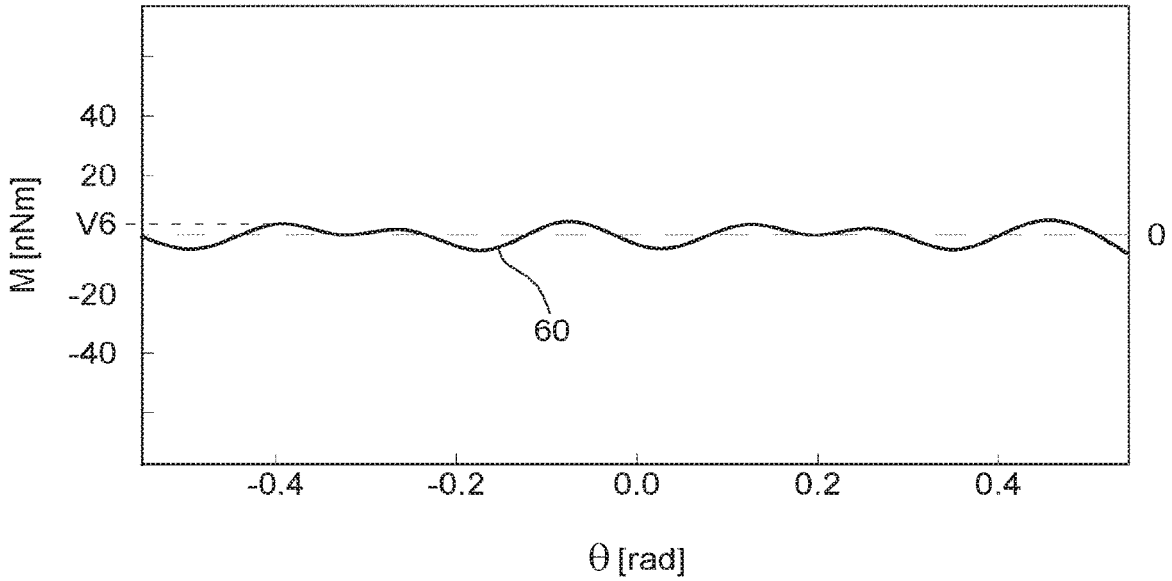
FIG. 12 shows the residual disturbance torque which is exerted on the escape wheel as a function of its angular position in the fourth embodiment.

Referring to FIGS. 11 and 12, a fourth embodiment of the invention will be described. This fourth embodiment differs from the second embodiment in that the single magnetic compensation pin of the second embodiment is replaced here with two magnetic compensation pins 32B and 32C which are arranged in the same manner as the third embodiment. This is therefore a case where the first set of magnetic elements comprises a plurality of functional magnetic elements, namely two magnetic arbors in the variant described, and the second set of magnetic elements comprises a plurality of magnetic compensation elements, namely two pins in this variant. The two compensation pins are arranged such that the two individual magnetic torques that they respectively exert on the escape wheel are phase shifted respectively by 120° and 240° relative to the first magnetic disturbance torque produced overall by the two magnetic arbors 18A and 42. In other words, the two magnetic compensation elements 50, 52 have here an angular offset relative to each other whereby the remainder of the integer division by angular period PA is equal to 360°/(3·N) where N is the number of angular periods of the annular magnetized structure, i.e. N=12 in the example considered. This remainder is equal to 10°, such that the angle DA5 between the two pins 32B and 32C is equal to 40° in the example represented in FIG. 11, namely an angular period (equal to 30°) to which is added the remainder of 10°. It will be noted that, because account is taken of the effect of pallet shaft 18A, angle DA6 between arbor 42 and pin 32B does not correspond to an integer number of period PA to which 10° is added or subtracted, although this angle DA6 comes close thereto, because arbor 42 is dominant in the first magnetic disturbance torque generated by the two functional magnetic elements on the escape wheel.

Resultant torque curve 60 resulting from the addition of the first magnetic disturbance torque, generated overall by the first set of magnetic elements and the second magnetic disturbance torque generated overall by the second set of magnetic elements, is represented in FIG. 12. In other words, the resultant torque is the result of the addition of all the individual magnetic disturbance torques that are considered. The annular magnetized structure of the fourth embodiment is configured and the two magnetic compensation elements are arranged such that the maximum absolute value V6 of the resultant torque is less than 15%, or 12% of the maximum absolute value V3 (see FIG. 8C) of the first magnetic compensation torque. Those skilled in the art can optimise the system by specifically configuring the two compensation pins which are preferably identical, in particular their respective diameters and their respective distances from the axis of rotation. It will be noted, in particular, that the two pins 32B and 32C are not respectively identical here, in their respective configurations and their relative arrangement at the periphery of escape wheel 36, to the two arbors 18A and 42. If this were the case, this would be a variant of the second embodiment wherein the two pins together form a group of magnetic elements to be considered as an inseparable whole and not individually, i.e. not as two distinct compensation elements whose individual magnetic disturbance torques could exhibit different phase shifts relative to the first magnetic disturbance torque and selected as explained above. Indeed, in the context of the fourth embodiment, to obtain the desired effect, namely to best compensate for the first two harmonics of the first magnetic disturbance torque curve (see FIG. 8C) and thereby minimise the amplitude of the disturbance torque on the escape wheel, the two compensation pins should preferably, in their respective configurations, particularly their dimensions and the material of which they are made, and their respective arrangements relative to the axis of rotation particularly the distance from the axis of rotation, be substantially identical to compensation pin 32A of the second embodiment which optimises the result of this second embodiment, or have the same effect as this compensation pin 32A on the annular magnetized structure.

Generally in the context of the third and fourth embodiments, the second set of magnetic elements consists of K magnetic compensation elements or K groups of magnetic compensation elements having substantially the same configuration, K being an integer number greater than one (K>1). The K magnetic compensation elements or groups of magnetic compensation elements are arranged such that K magnetic disturbance torques, respectively generated on the rotating element provided with the annular magnetized structure by these K magnetic compensation elements or groups of magnetic compensation elements, exhibit relative to the first magnetic disturbance torque, generated by the functional magnetic elements, respectively K angular phase shifts which are respectively equal to substantially J·360°/(K+1) where J is an integer number ranging from one to K, namely J=1, . . . , K.

In a preferred embodiment, the integer number K is equal to two (K=2) and the two magnetic compensation elements or groups of magnetic compensation elements are similar to each other, one of the two magnetic compensation elements or groups of magnetic compensation elements exhibiting relative to the other an angular offset whereby the remainder of the integer division by said angular period is equal to 360°/(3·N), N being the number of periods in a 360° range of the first magnetic disturbance torque curve.

In other embodiments, wherein the integer number K is greater than two (K>2), the K magnetic compensation elements or groups of magnetic compensation elements are similar to each other and a certain magnetic compensation element or group of magnetic compensation elements, among said K magnetic compensation elements or groups of magnetic compensation elements exhibits relative to the other compensation magnetic elements or groups of magnetic compensation elements K−1 angular offsets whereby the K−1 remainders of the integer division of each by the angular period are respectively equal to J·360°/[(K+1)·N] where J is an integer number ranging from one K−1, i.e. J=1, . . . , K−1.

Finally, in a particular embodiment wherein the first set of magnetic elements considered consists of a single functional magnetic element, the positive integer number N is thus equal to a number of angular periods exhibited by the annular magnetized structure, and the K magnetic compensation elements are arranged to exhibit relative to the single functional magnetic element K angular offsets whereby the K remainders of the integer division of each by the angular period are respectively equal to J·360°/[(K+1)·N] where J is an integer number ranging from one to K, namely J=1, . . . , K.

The invention claimed is:

1. A timepiece movement comprising:

a mechanism including:

a rotating element, provided with an annular magnetized structure exhibiting an angular variation of at least one physical parameter defining said annular magnetized structure, and a first set of magnetic elements which is formed of one functional magnetic element or of a plurality of functional magnetic elements, said first set of magnetic elements not being integral in rotation with said rotating element and having overall with the annular magnetized structure a first magnetic interaction which generates on said rotating element a first magnetic disturbance torque; and a second set of magnetic elements which includes a magnetic compensation element or of a plurality of magnetic compensation elements, said second set of magnetic elements not being integral in rotation with said rotating element and having overall with the annular magnetized structure a second magnetic interaction which generates on said rotating element a second magnetic disturbance torque, and wherein the second set of magnetic elements is arranged relative to the first set of magnetic elements such that the maximum absolute torque value resulting from the addition of the first and second magnetic disturbance torques is lower than the maximum absolute value of the first magnetic disturbance torque.

2. The timepiece movement according to claim 1, wherein the first magnetic disturbance torque as a function of the angular position of said rotating element defines a first sinusoidal curve having an angular period equal to 360°/N, with N being an integer number greater than one (N>1); and wherein the second set of magnetic elements is arranged relative to the first set of magnetic elements such that the second magnetic disturbance torque as a function of the angular position of said rotating element defines a second sinusoidal curve also having said angular period, and such that the first and second magnetic disturbance torques exhibit therebetween an angular phase shift substantially equal to 180°.

3. The timepiece movement according to claim 2, wherein the second set of magnetic elements consists only of said magnetic compensation element; and wherein the annular magnetized structure is configured and said magnetic compensation element is arranged such that the maximum absolute value of said resultant torque is less than 30% of the maximum absolute value of the first magnetic disturbance torque.

4. The timepiece movement according to claim 2, wherein the second set of magnetic elements consists of K magnetic compensation elements or K groups of magnetic compensation elements substantially having the same configuration, K being an integer number greater than one (K>1); and wherein said K magnetic compensation elements or groups of magnetic compensation elements are arranged such that K individual magnetic disturbance torques generated on the rotating element respectively by said K magnetic compensation elements or groups of magnetic compensation elements, exhibit relative to said first magnetic disturbance torque respectively K angular phase shifts which are respectively equal to substantially J·360°/(K+1) with J being an integer number ranging from one to K, i.e. J=1, . . . , K.

5. The timepiece movement according to claim 4, wherein the integer number K is equal to two (K=2), wherein the two magnetic compensation elements or groups of magnetic compensation elements are similar to each other, one of the two magnetic compensation elements or groups of magnetic compensation elements exhibiting relative to the other an angular offset whereby the remainder of the integer division by said angular period is equal to 360°/(3·N).

6. The timepiece movement according to claim 5, wherein the annular magnetized structure is configured and the two magnetic compensation elements are arranged such that the maximum absolute value of said resultant torque is less than 15% of the maximum absolute value of the first magnetic disturbance torque.

7. The timepiece movement according to claim 4, wherein the integer number K is greater than two (K>2), wherein said K magnetic compensation elements or groups of magnetic compensation elements are similar to each other, a certain magnetic compensation element or group of magnetic compensation elements among said K magnetic compensation elements or groups of magnetic compensation elements exhibiting relative to the other magnetic compensation elements or groups of magnetic compensation elements K−1 angular offsets whereby the K−1 remainders of the integer division of each by the angular period are respectively equal to J·360°/[(K+1)·N] where J is an integer number ranging from one K−1, i.e. J=1, . . . , K−1.

8. The timepiece movement according to claim 4, wherein the first set of magnetic elements considered consists only of said functional magnetic element, the positive integer number N thus being equal to a number of angular periods exhibited by the annular magnetized structure; wherein said K magnetic compensation elements (50, 52) are arranged to exhibit relative to said functional magnetic element K angular offsets whereby the K remainders of the integer division of each by said angular period are respectively equal to $J \cdot 360°/[(K+1) \cdot N]$ where J is an integer number ranging from one to K, namely J=1, . . . , K.

9. The timepiece movement according to claim 1, wherein said rotating element is a magnetic escape wheel forming a magnetic escapement.

10. The timepiece movement according to claim 9, wherein said functional magnetic element is a shaft of a magnetic pallet fork also forming said magnetic escapement, said shaft being formed by a ferromagnetic material; and wherein the annular magnetized structure defines magnetic barriers for the magnetic pallet fork which are angularly offset by said angular period.

11. The timepiece movement according to claim 9, wherein said magnetic compensation element is a pin arranged at the periphery of the magnetic escape wheel and formed by a ferromagnetic material.

12. The timepiece movement according to claim 9, wherein the annular magnetized structure has a constant thickness, said angularly variable physical parameter being the radial width of said annular magnetized structure.

13. The timepiece movement according to claim 9, wherein the annular magnetized structure is configured such that the external profile thereof is circular and continuous.

14. The timepiece movement according to claim 1, wherein said magnetic compensation element is arranged such that the position thereof relative to said rotating element can be adjusted to regulate said angular phase shift and to optimise said maximum intensity of said resultant torque.

* * * * *